US005213264A

United States Patent [19]

Styne

[11] Patent Number: 5,213,264

[45] Date of Patent: May 25, 1993

[54] SPRAYING DEVICE WITH A REPLACEABLE CARTRIDGE

[75] Inventor: James J. Styne, San Ramon, Calif.

[73] Assignee: Chevron Research and Technology Company, San Francisco, Calif.

[21] Appl. No.: 595,523

[22] Filed: Oct. 11, 1990

[51] Int. Cl.[5] ..... B05B 7/30

[52] U.S. Cl. ..... 239/309; 239/315; 239/317; 239/318; 239/581.1; 222/85

[58] Field of Search ..... 239/309, 310, 315, 317, 239/318, 581.1; 222/85, 86, 325

[56] References Cited

U.S. PATENT DOCUMENTS

| | | | |
|---|---|---|---|
| 1,458,975 | 6/1923 | Clauson | 239/317 |
| 1,703,205 | 2/1929 | Pearsons | 239/315 X |
| 2,006,437 | 7/1935 | Burgess et al. | 299/88 |
| 2,591,364 | 4/1952 | Kurth | 239/317 |
| 2,599,678 | 6/1952 | Walker | 299/83 |
| 2,711,928 | 6/1955 | Randa | 299/84 |
| 2,750,231 | 6/1956 | Cox | 239/310 X |
| 2,760,820 | 8/1956 | Cirese | 299/83 |
| 3,104,823 | 9/1963 | Hayes | 239/304 |
| 3,165,114 | 1/1965 | Garrett | 137/268 |
| 3,181,797 | 5/1965 | Hayes | 239/317 |
| 3,198,438 | 8/1965 | Hultgren | 239/318 |
| 3,255,972 | 6/1966 | Hultgren et al. | 239/318 |
| 3,454,229 | 7/1969 | Armond | 239/318 X |
| 3,499,606 | 3/1970 | Smith | 239/304 |
| 3,554,450 | 1/1971 | Muhala | 239/309 |
| 3,915,191 | 10/1975 | Eisenthal | 137/268 |
| 3,940,069 | 2/1976 | Gunzel, Jr. et al. | 239/318 |
| 4,027,822 | 6/1977 | Usher | 239/305 |
| 4,369,921 | 1/1983 | Beiswenger et al. | 239/317 |
| 4,385,034 | 5/1983 | Gacer | 239/317 X |
| 4,491,254 | 1/1985 | Viets et al. | 222/83.5 |
| 4,767,058 | 8/1988 | La Rosa et al. | 239/309 |
| 4,878,619 | 11/1989 | Norman | 239/318 |
| 4,901,923 | 2/1990 | McRoskey et al. | 239/310 X |

*Primary Examiner*—Andres Kashnikow
*Assistant Examiner*—William Grant
*Attorney, Agent, or Firm*—Edward J. Keeling; Matt W. Carson

[57] ABSTRACT

A spraying device having a sprayer head and an interchangeable, disposable, recyclable and/or biodegradable, and attachable cartridge, capable of diluting and dispensing a chemical. The device has a rotatable barrel valve to select whether to fill the cartridge, spray the diluted chemical, or prevent any flow. The device further has a pair of coupling tubes which permit the easy connection of the sprayer head to the cartridge in a way to cause, by aspiration, the partially diluted chemical to enter the sprayer head for further mixing and discharge. A rupturable or replaceable membrane is placed across the top of the cartridge to contain the concentrated chemical prior to use. A plug closure permits the addition of a chemical to the cartridge.

8 Claims, 3 Drawing Sheets

SPRAYING DEVICE WITH A REPLACEABLE CARTRIDGE

FIELD OF THE INVENTION

This invention relates to the field of lawn and garden chemical application. More specifically, the invention is an apparatus which dilutes and dispenses a chemical which is stored in an interchangeable and recyclable and/or biodegradable cartridge.

BACKGROUND OF THE INVENTION

There are many spray gun type applicators known in the art of lawn and garden chemical application. Typical hose end lawn or garden sprayers are aspirator units which apply fertilizers, pesticides or other chemicals at a fixed, low dilution ratio. To utilize concentrates which must be diluted to high ratios, the user normally predilutes the concentrate with water. This is accomplished by volume measurement of the concentrate with a spoon, cap or other measuring device into a sprayer mix jar. Water is then added to obtain the proper premix concentration. The prediluted concentrate is then further diluted to its final dilution ratio as the sprayer is operated.

Such predilution procedures require the manual handling of concentrated chemicals with its attendant risks. Moreover, the user must generally purchase the concentrate in larger quantities than are necessary for a single application and thus containers of the concentrated chemical must be stored for extended periods after they have been opened. On the other hand devices which attempt to avoid predilution by diluting the concentrate at a high ratio in one (1) step are not satisfactory because of very poor accuracy. The concept of two-step mixing or dilution of chemicals, including such use in spraying devices is known. See, for example, U.S Pat. Nos. 2,006,437; 2,599,678; 2,711,928; 2,760,820; 3,104,823; 3,181,797; 3,499,606; and 4,027,822. However, the devices shown in these patents are either cumbersome or otherwise unsuitable for garden spray devices.

U.S. Pat. No. 3,165,114 issued to Garret discloses a dispensing package of fluid soluble material capable of use with a standard feed mixer device. Some of the flowing water is diverted don through a nipple and inlet tube into the bottom of the package. Suction draws the dissolved material through an outlet tube. The device requires water to constantly flow through it, and does not provide a barrel valve which could shut off or control the flow.

U.S. Pat. No. 3,198,438 issued to Hultgren, et al. requires a trigger action to push a tapered plug out of an aperture, allowing water to flow into a mixing chamber to create a venturi suction to draw fluid out of a collapsible container. The device will not permit the use of a solid chemical, and does not have applicant's inventive use of a rotatable barrel valve to dilute a chemical or to control the discharge of the diluted solution into the environment. U.S Pat. No. 3,255,972, also issued to Hultgren, et al. discloses a disposable container for use with sprayers of the type disclosed in the '438 patent.

U.S. Pat. No. 3,554,450, issued to D'Muhala teaches a spray gun which accommodates removable cartridges containing various solids or liquids. An end cap is unscrewed to control water through a mixing chamber and out a nozzle. The device does not provide for reusable cartridges, as each cartridge must be pierced to permit mixing with the water flow. There is no means to partially dilute a chemical, or to convert a solid chemical to a fluid prior to expulsion through the nozzle.

U.S. Pat. No. 3,915,191 discloses a water mixing device for a shower which may be fitted to the taps of a bath. A selector valve selectively permits water from an inlet chamber to flow through various enclosures of a second chamber. At least one (1) enclosure has a container to receive a soluble substance such as soap. No initial dissolution of the soap is provided for, and the soap is transported by direct flow of the water, and not drawn by aspiration.

U.S. Pat. No. 4,491,254 issued to Viets, et al. teaches an applicator for dispensing a chemical in dilute aqueous form. The applicator has two (2) containers. The second container receives a chemical which has been diluted with water from the first container. A two-position, rotatable valve directs the flow of water into either the first container to predilute a chemical, or to flow across an aspirator to mix with the prediluted chemical and discharge it through the exit end of a passageway. Viets' device requires removing caps from the containers to add chemicals, and to thread the containers together to attach them, a cumbersome and potentially dangerous procedure. The valve taught by Viets, et al. only has two (2) positions. Water is constantly flowing either into the second container to dilute a chemical or through the passageway. An operator must use a conventional nozzle, which must be specially adapted to attach to the applicator to turn the water on or off to control the flow.

The prior work is limited in the attempts to easily, economically, safely, and environmentally soundly provide a device to dilute and dispense various insecticides, herbicides, cleaners, and fertilizers. There is therefore a need for a spraying device that provides an operator with immediate flow control, and a disposable, recyclable and/or biodegradable cartridge that is quick and easy to attach to a sprayer head.

SUMMARY OF THE INVENTION

The present invention is a spraying apparatus comprising a sprayer head and an interchangeable, disposable, and recyclable and/or biodegradable cartridge. The sprayer head comprises a fluid inlet conduit which directs flow to a rotatable barrel valve which has a flow channel network that has three (3) positions. A first, spray position directs flow through a first fluid discharge conduit into a mixing chamber. A second, fill position, directs the fluid through a fluid inlet coupling tube, having a distant end which extends through the bottom edge of a sealed housing. The third, off, barrel valve position permits no flow to occur.

A fluid outlet coupling tube has a first end in communication with and terminating at the mixing chamber. A distant end extends through the bottom edge of the sealed housing in nearly the same direction as the inlet coupling tubes. Both coupling tubes have a sharp extremity which can rupture a membrane placed over the top of the cartridge. Flow through the first discharge conduit draws a second fluid from the fluid outlet coupling tube into the mixing chamber. The resulting mixed fluid is then discharged through a second discharge conduit, into the environment. The sealed housing permits flow only through the conduits, coupling tubes, valve, and the mixing chamber.

The cartridge is able to contain a second fluid or a solid chemical. A cartridge housing with an open top end and a closed bottom end contains the second fluid. A cartridge lid is sealably attached to the open top end, and has a fluid inlet which is sealably mateable with the distant, male end of the fluid inlet coupling tube. The lid also has a dip tube extending nearly to the bottom end of the cartridge housing, which is mateable with the distant, male end of the fluid outlet coupling tube to attach the sprayer head to the cartridge. When the barrel valve is in its second, fill position, a fluid is directed to flow into the cartridge to dilute the second fluid or solid chemical. After the valve is rotated to its first, spray position, flow is directed into the mixing chamber and past the fluid outlet coupling tube to withdraw and further dilute the second fluid. The mixed and diluted second fluid is then discharged through the fluid discharge conduit into the environment.

A rupturable or replaceable membrane is placed across the open top of the cartridge lid to contain the second fluid. The barrel valve is mounted for rotation within the sprayer head at right angles to the coupling tube. The cartridge lid has a plug closure means to permit the addition of a second fluid or solid chemical to the cartridge.

DETAILED DESCRIPTION OF THE INVENTION

In accordance with the present invention, a new improved method and apparatus for diluting and dispensing a chemical, which is stored in an interchangeable, replaceable and recyclable and/or biodegradable cartridge, has been developed.

Figure 1:
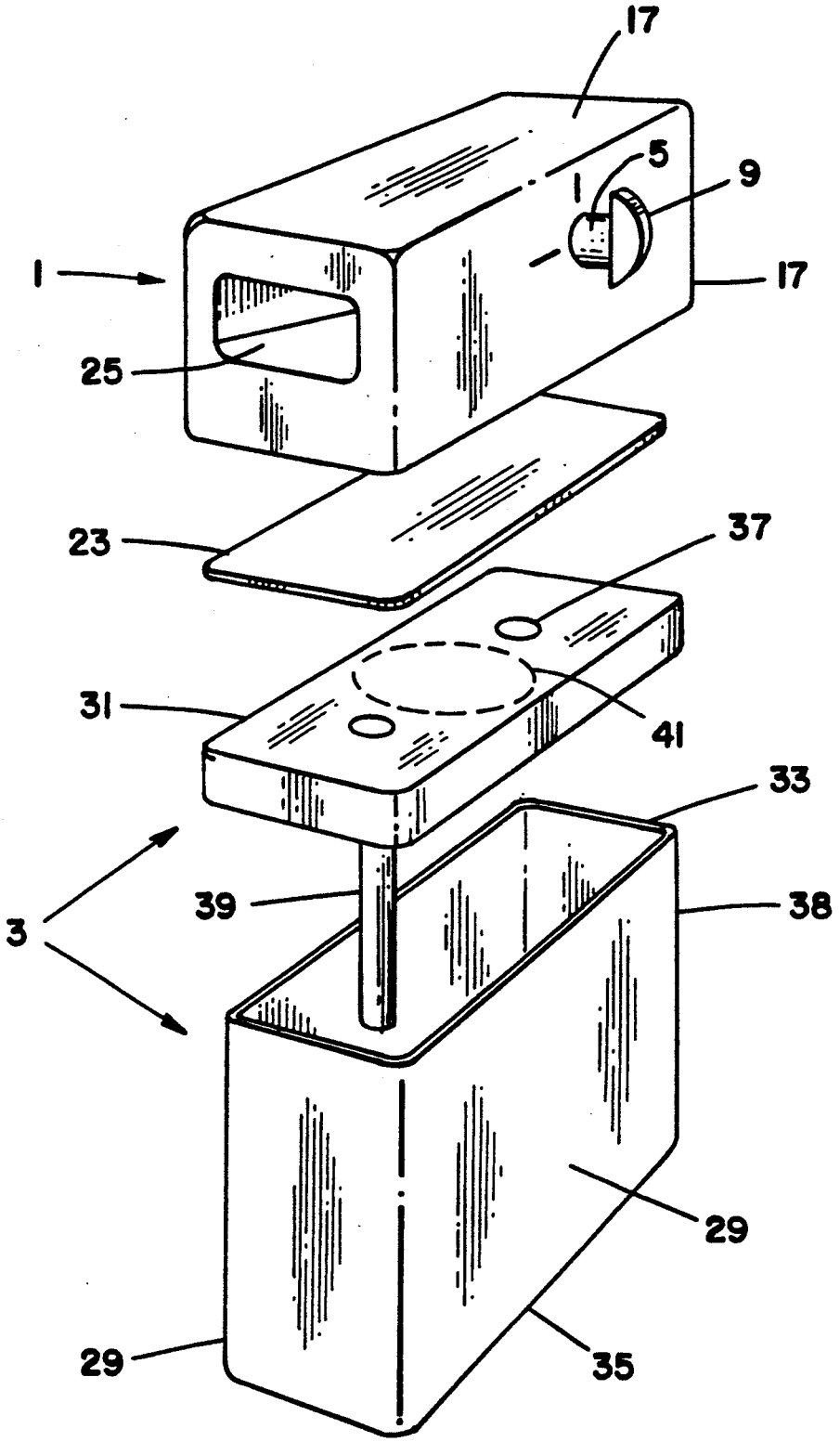
FIG. 1 is a schematic top/front/side view, partly in elevation and partly broken away, of one (1) embodiment of the apparatus.
Figure 2:
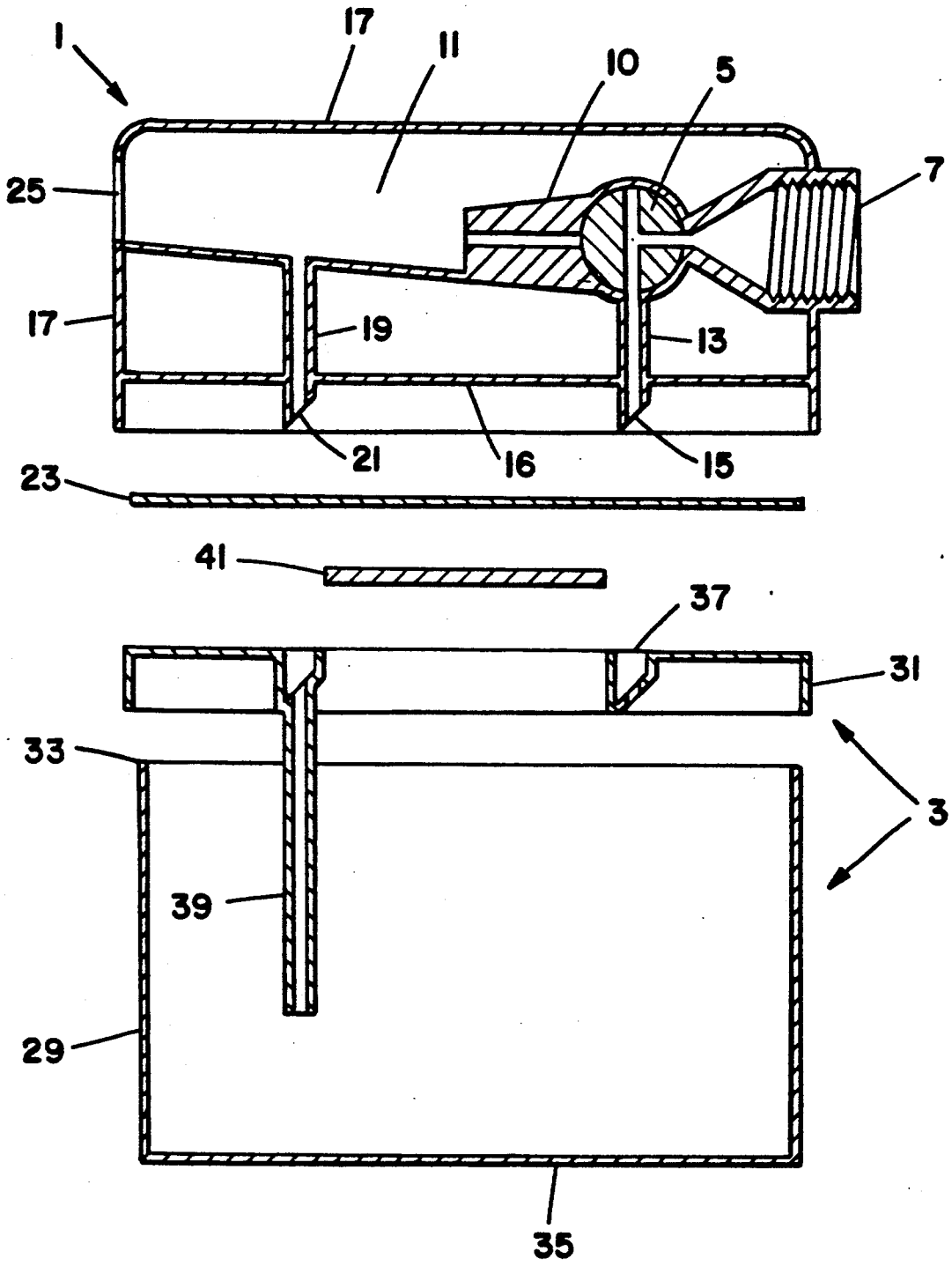
FIG. 2 is a side sectional view, partly broken away, of one (1) embodiment of the apparatus.

Referring to FIGS. 1 and 2, a first embodiment of the device comprises two (2) main components, a sprayer head 1 and an interchangeable, replacable, disposable, and recyclable and/or biodegradable cartridge 3. The sprayer head 1 has only one (1) movable part, a barrel valve 5. A fluid inlet conduit 7 directs a first fluid into the sprayer head 1 and to the barrel valve 5. In the preferred embodiment, the fluid inlet conduit 7 is designed to sealably and threadably mate with the male end of a garden hose. In other embodiments, the fluid inlet conduit 7 may be designed to sealably mate with any size hose or fluid connection means.

Figure 3C:
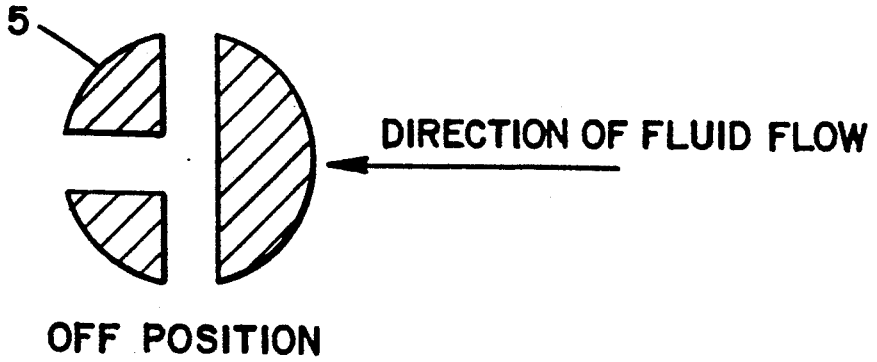
FIGS. 3(A), 3(B), and 3(C) are side sectional views of the barrel valve of the apparatus showing its "SPRAY POSITION", "FILL POSITION", and "OFF POSITION", respectively.
Figure 3B:
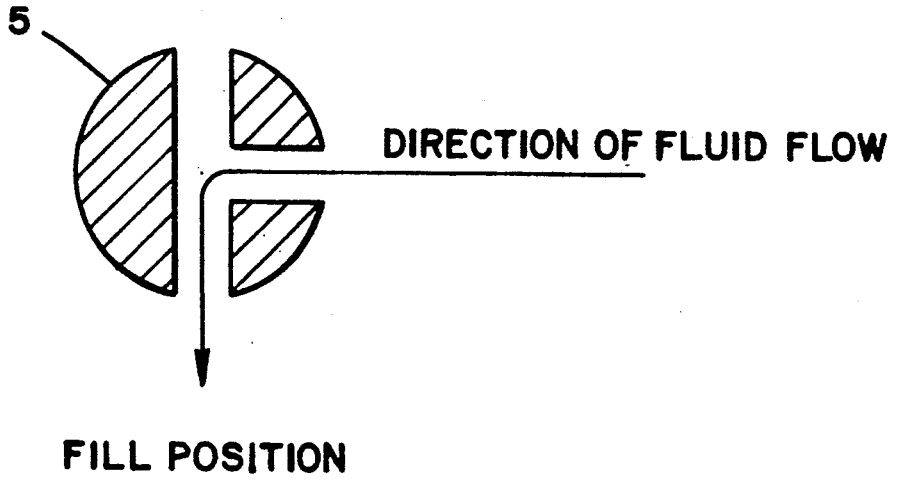
Figure 3A:
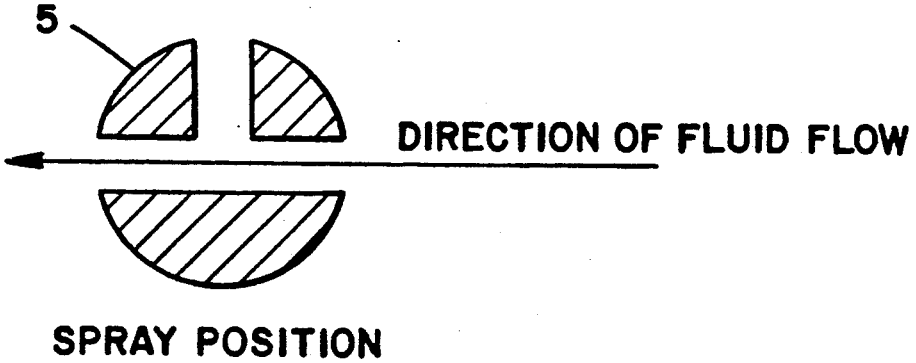

The barrel valve 5 has a flow channel network, as seen on FIGS. 3(A), 3(B), and 3(C), to permit three (3) types of fluid flow, which may be selected by rotating the barrel valve handle 9. A first, spray position as shown on FIG. 3(A), directs the flow through the barrel valve through a first fluid discharge conduit 10, into a mixing chamber 11. A second, fill position, as shown on FIG. 3(B) directs the fluid through a fluid inlet coupling tube 13. The fluid inlet coupling tube 13 has a distant end 15 which extends through the bottom edge 16 of a sealed housing 17. The third barrel valve position, off, as shown on FIG. 3(C), permits no flow to occur through the barrel valve 5.

A fluid outlet coupling tube 19 has a first end that is in communication with and terminates at the mixing chamber 11. The fluid outlet coupling tube 19 extends through the bottom edge 16 of the sealed housing 17. A distant end 21 extends in nearly the same direction as the inlet coupling tube 13. The distant ends, 15 and 21 of both coupling tubes, 13 and 19 respectively each have a sharp extremity which is capable of rupturing a membrane 23, which may be placed over the top of the cartridge.

Flow through the first fluid discharge conduit 10, into the mixing chamber 11 draws a second fluid from the fluid outlet coupling tube 19 into the mixing chamber 11 by aspiration. The second fluid is a partially diluted chemical, stored in the interchangeable, disposable, and recyclable and/or biodegradable cartridge 3. The resulting mixed fluid is then forcibly discharged through a second discharge conduit 25, into the environment. The device may therefor mix chemicals such as pesticides, herbicides, insecticides, waxing or washing products, engine cleaners, automobile cleaners, waxes, driveway cleaners, or fertilizers, and provides the user with an easy, accurate, and inexpensive means to apply the above compounds. The novel use of the rotatable barrel valve 5 provides for fingertip control over the type of fluid flow desired. The sealed housing 17 is designed to permit flow only through the conduits, coupling tubes, barrel valve, and the mixing chamber. In the preferred embodiment, the barrel valve 5 is mounted on the sprayer head housing 17 for rotation within the sprayer head 1 at right angles to the coupling tubes 13 and 19.

The interchangeable, disposable, and recyclable cartridge 3 is comprised of a cartridge housing 29 and a cartridge lid 31. In a preferred embodiment, the cartridge 3 is comprised of a recycleable and/or biodegradable material. The cartridge housing 29 has an open top end 33 and a closed bottom end 35, and a second fluid, that is to be diluted with the first fluid and discharged into the environment, is stored therein.

The cartridge lid 31 is sealably attached to the open top end 33. The lid 31 has a fluid inlet 37 which is sealably mateable with the distant, male end 15 of the fluid inlet coupling tube 13. The lid 31 also has a dip tube 39 which extends nearly to the bottom end 35 of the cartridge housing 35 when the lid 31 is attached to the cartridge housing 35. The dip tube 39 is sealably mateable with the distant, male end 21 of the fluid outlet coupling tube 19.

In operation, a specified amount of a concentrated chemical such as a cleaner, a pesticide, an insecticide, a fertilizer, or a herbicide is placed in the cartridge housing 29, and the cartridge lid 31 is then sealably attached, as shown in FIGS. 1 and 2. In another embodiment, a membrane 23 is placed across the top end of the cartridge lid 31, for containing the second fluid therein.

In one embodiment, the membrane 23 is rupturable so that the sharp extremities of the distant ends, 15 and 21 of both coupling tubes 13 and 19 respectively will puncture the membrane 23 when the sprayer head 1 is attached to the cartridge 3. In another embodiment, the membrane 23 is removable, to permit attaching the sprayer head 1 to the cartridge 3.

The cartridge 3 is then easily attached to the sprayer head 1 by snapping the two (2) components together. The distant, male end 15 of the fluid inlet coupling tube 13 sealably mates with the fluid inlet 37, and the distant, male end 21 of the fluid outlet coupling tube 19 sealably mates with the dip tube 39. The cartridge 3 and the sprayer head 1 can be easily separated after use, to attach a new cartridge 3 if desirable.

In operation, after attaching the cartridge 3 to the sprayer head 1, the rotatable barrel valve 5 is placed in its second, fill position. A fluid, typically water, is directed to flow through the fluid inlet coupling tube 13, through the fluid inlet 37 and into the cartridge 3. A fill line 38 on the cartridge housing indicates the proper amount of fluid to add to the cartridge 3 to partially dilute the second fluid. A solid concentrated chemical may be used as well as a liquid concentrated chemical. The solid chemical will turn into a liquid by the addition of the first fluid.

When the correct amount of fluid has been added, the barrel valve 5 is easily rotated to its third, off position until the operator is ready to begin dispensing the mixture. When ready, the operator rotates the barrel valve 5 to its first, spray position. The fluid now is directed to flow through the first fluid discharge conduit 10 into the mixing chamber 11 and past the fluid outlet coupling tube 19. The resulting aspirational pressure differential draws the second, partially diluted fluid up the dip tube 39 and up the fluid outlet coupling tube 19 into the mixing chamber 11. The second fluid is now further diluted by mixing with the first fluid and is forcibly discharged through the second discharge conduit 25.

In another embodiment, the cartridge lid 31 has a plug closure means 41 to permit the addition of a second fluid or second dry chemical to the cartridge 3. After the operator finishes dispensing the properly diluted second fluid or second dry chemical, the barrel valve 5 is now rotated back to its third, off position. The cartridge 3 may be now easily removed from the sprayer head 1, and may be replaced with another cartridge 3, or a new concentrated chemical may now be added to the cartridge 3, via the plug closure means 41. The cartridge is made of a biodegradable and/or recyclable material, so disposal is not a problem, if desirable.

While a preferred embodiment of the invention has been described and illustrated, it should be apparent that many modifications can be made thereto without departing from the spirit or scope of the invention. Accordingly, the invention is not limited by the foregoing description, but is only limited by the scope of the claims appended hereto.

What is claimed is:

1. A spraying apparatus, said spraying apparatus comprising:

a sprayer head further comprising:

a fluid inlet conduit;

a rotatable barrel valve having a flow channel network such that when in a first, spray position, a first fluid is directed to flow from said inlet conduit through a first fluid discharge conduit into a mixing chamber, and when rotated to a second, fill position, said first fluid is directed to flow from said inlet conduit through a fluid inlet coupling tube, said fluid inlet coupling tube having a distant end extending through the bottom edge of a sealed housing, and when rotated to a third, off position, no flow occurs;

a fluid outlet coupling tube having a first end in fluid communication with and terminating at said mixing chamber, said fluid outlet coupling tube having a distant end extending through said bottom edge of said sealed housing in a direction nearly equivalent to that of said fluid inlet coupling tube so that said first fluid flowing through said first fluid discharge conduit can draw a second fluid from said fluid outlet coupling tube into said mixing chamber, and that a resulting mixed fluid is discharged through a second discharge conduit, into the environment, said housing sealing said sprayer head to permit flow only through said conduits, coupling tubes, valve, and mixing chamber;

an interchangeable and disposable cartridge able to contain said second fluid therein a said cartridge further comprising:

a cartridge housing for containment of said second fluid within said cartridge, having an open top end and a closed bottom end;

a cartridge lid sealably attached to said open top end, said lid having a top, and a fluid inlet, said fluid inlet sealably mateable with said distant end of said fluid inlet coupling tube, said lid also having a dip tube extending downward from said lid nearly to said bottom end of said cartridge housing, said dip tube sealably mateable with said distant end of said fluid outlet coupling tube to attach said sprayer head to said cartridge, so that when said barrel valve is in its second, fill position, said first fluid can be directed to flow into said cartridge to partially dilute said second fluid, and so that when said barrel valve is subsequently rotated to said first, spray position, said first fluid can be directed to flow into said mixing chamber and past said fluid outlet coupling tube to withdraw and further dilute said second fluid from said cartridge.

2. The spraying apparatus of claim 1 wherein said interchangeable and disposable cartridge contains a rupturable membrane placed across said top of said cartridge lid thereof, for containing said second fluid inside said cartridge.

3. The spraying apparatus of claim 2 wherein said coupling tubes contain a sharp extremity thereof which can rupture said membrane so that said coupling tubes can mate with said cartridge lid.

4. The spraying apparatus of claim 2 wherein said rupturable membrane is removable.

5. The spraying apparatus of claim 3 wherein said interchangeable and disposable cartridge is comprised of a recyclable material.

6. The spraying apparatus of claim 5 wherein said cartridge lid has a plug closure means to add said second fluid to said cartridge.

7. The spraying apparatus of claim 5 wherein said cartridge contains a solid chemical which can be converted to said second fluid by the addition of said first fluid from said fluid inlet coupling tube.

8. The spraying apparatus of claim 3 wherein said interchangeable and disposable cartridge is comprised of a biodegradable material.

* * * * *